US005531292A

United States Patent [19]

Bell

[11] Patent Number: 5,531,292

[45] Date of Patent: Jul. 2, 1996

[54] HARNESS WITH ADJUSTABLE MEANS FOR SUPPORTING A TOOL BELT

[76] Inventor: Michael Bell, 1705 Triumphe Way, Warrington, Pa. 18976

[21] Appl. No.: 292,906

[22] Filed: Aug. 19, 1994

[51] Int. Cl.[6] ..... A62B 1/06

[52] U.S. Cl. ..... 182/3; 182/6

[58] Field of Search ..... 182/3–7, 9; 244/151 R

[56] References Cited

U.S. PATENT DOCUMENTS 5,067,585 11/1991 Bell ..... 182/7

5,378,046 1/1995 Gordy ..... 182/3

*Primary Examiner*—Alvin C. Chin-Shue

*Attorney, Agent, or Firm*—Caesar, Rivise, Bernstein, Cohen & Pokotilow

[57] ABSTRACT

A harnesses for protecting a worker from a fall off of an elevated structure. The harness is arranged to suspend a tool belt therefrom and harness comprises a pair of leg straps, a pair of upper torso straps, a pair of rappelling straps, a seat strap, and four belt suspenders. Each of the upper torso straps includes a chest strap portion and a back strap portion, with the chest strap portions extending across respective portions of the chest of the worker. The back strap portions extend across respective portions of the back of the worker. Two of the belt suspenders are mounted on respective ones of the back strap portions and include extendable free end portions have respective hooks thereon for releasable securement to respective rear portions of the tool belt. The other two belt suspenders are mounted on respective ones of the chest strap portions and include respective hooks for releasable securement to respective front portions of the tool belt. The upper torso straps are adjustable in length to enable the tool belt suspended by said belt suspenders to be raised or lowered in the front and back by the adjustment of the length of the upper torso straps.

7 Claims, 4 Drawing Sheets

HARNESS WITH ADJUSTABLE MEANS FOR SUPPORTING A TOOL BELT

BACKGROUND OF THE INVENTION

This invention relates generally to safety apparatus and more particularly to a safety harness arranged to be worn by a person for suspending a conventional tool belt or lineman's belt therefrom.

As a result of the enactment of various safety laws persons working at elevated height positions, e.g., window washers, telephone lineman, etc., are required to be protected against falls. One common approach to achieve that end is the use of a safety belt which is worn on the worker's waist. The belt is arranged to be worn about the waist of the workman and includes a D-ring or some other metal loop fixedly mounted on the belt in the center of the portion located at the worker's back. The D-ring is arranged to be "tied off" i.e., connected, via a lanyard or some other means, to a supporting member, e.g., a portion of a building or other static structure, a rope grab device mounted on a safety line, etc. Thus, once the worker is tied off should he/she fall off of the platform, scaffolding, or other support on which he/she is working or if that platform etc. itself drops or otherwise falls away, the worker will be prevented from falling to the ground.

While such safety belts are generally suitable for their intended purposes they are not designed to act as a primary means for suspending the person at an elevated position to enable him/her to perform some activity while so suspended. In fact such safety belts are generally incapable of such use since they tend to inhibit the person's mobility, thus interfering with the worker's ability to function efficiently when he/she is tied off.

Harnesses have been developed and sold to serve as a means to distribute the shock load across portions of the body of the wearer for fall protection purposes. Examples of such harness are those disclosed and claimed in my U.S. Pat. No. 5,329,884, and which is commercially available from Descent Control, Inc. of Fort Smith, Ak. That harness include straps or loops which are arranged to encircle the wearer's thighs, a belt or some other portion to encircle the wearer's waist, and straps extending over the wearer's shoulders.

Many workers utilize safety harnesses along with a tool belt, e.g., a "lineman's" belt, with the harness serving to provide fall protection, and with the belt used to carry tools or to aid in climbing or for positioning purposes when used with a lanyard to encircle the pole or other structure being climbed. To achieve positioning the belt is commonly slipped down over the workers hips so that it extends across the worker's buttocks, thereby acting as a seat for the worker. When positioning is no longer necessary the worker then slips the belt up to its normal position about the waist. Since such belts are frequently quite heavy the action is moving the belt from one position about the workers waist to another position about the worker's buttocks, and vice versa can be difficult to achieve, especially if the worker is at an elevated position, e.g., on a telephone pole. Thus, a need exists for a harness means for suspending a conventional tool belt or lineman's climbing belt therefrom to enable the belt to be readily adjusted to either the normal about-the-waist position or to an about-the-buttocks positioning position.

Suspenders have been commercially available for use with a tool belt to suspend it therefrom and thereby ease the weight of the belt on the worker. One such pair of suspender is that offered by Bashlin Industries, Inc. of Grove City Pa. under the trade designation "SAM BROWN SUSPENDERS" (Catalog 980-1, page 13, No. 80). That same company also offers a harness under the trade designation "THE 'ONE' LINEMEN'S HARNESS" (Catalog 980-1, page 12, No. 688NWD). As disclosed in that catalog the harness is a full body harness that attaches to a specific type of line belt, namely, a standard or semi floating shifting "D" linemen's belt. To that end, the front or chest straps of the harness include loops at their lower ends through which the front of the lineman's belt is threaded. The back straps of the lineman's belt extend through spaces between portions of the lineman's belt and are secured to the harnesses leg straps. While this harness may be suitable to suspend the front of the tool belt, its construction does not allow supporting the rear of the tool belt. Moreover, adjustment of the chest straps will not raise or lower all portions of the lineman's belt, only the front thereof. Further still, in the interests of safety the harness cannot be used safely with linemen's belts other than the standard or semi-floating shifting "D" linemen's belts, thereby limiting its use.

Thus, a need exists for a harness which overcomes the disadvantages of the prior art.

OBJECTS OF THE INVENTION

Accordingly, it is a general object of this invention to provide a harness which achieves that end.

It is another object of this invention to provide a full body harness including means for suspending both the front and back of any tool belt or linemen's belt therefrom.

It is still another object of this invention to provide a full body harness for suspending any tool belt or linemen's belt therefrom so that the height of the tool belt can be readily adjusted in the front and the back thereof.

It is yet another object of this invention to provide a full body harness which is simple in construction yet very effective for suspending any tool belt or linemen's belt therefrom

SUMMARY OF THE INVENTION

These and other objects of this invention are achieved by providing a harnesses formed of a flexible material to be worn by a person for supporting a tool belt therefrom. The harness includes a pair of upper torso straps, a pair of leg straps, and four belt suspenders. Each of the upper torso straps includes a chest strap portion and a back strap portion, with the chest strap portion extending across a portion of the chest of the person and with the back strap portion extending across a portion of the back of the person. Each of the leg straps is arranged for extending about a respective leg of the person. Each of the upper torso straps is adjustable in length.

Two of the belt suspenders are in the form of respective belt suspension straps and are mounted on respective ones of the back portions of the pair of upper torso straps. The other two of the belt suspenders are mounted on respective ones of the front portions of the pair of upper torso straps. Each of the two back-mounted belt suspension straps includes a free end having connector means mounted thereon. The two chest-mounted belt suspenders also include connector means. The four connector means serve to connect the harness to respective portions of the tool belt to suspend the tool belt from the harness.

In accordance with one preferred aspect of the invention each of the two back-mounted suspension straps includes releasable securement means for holding the strap in a stowed position closely adjacent the upper torso strap portion on which it is mounted.

DESCRIPTION OF THE DRAWINGS

Other objects and many attendant features of this invention will become readily appreciated as the same becomes better understood by reference to the following detailed description when considered in connection with the accompanying drawings wherein.

DETAILED DESCRIPTION OF THE PREFERRED EMBODIMENTS

Figure 1:
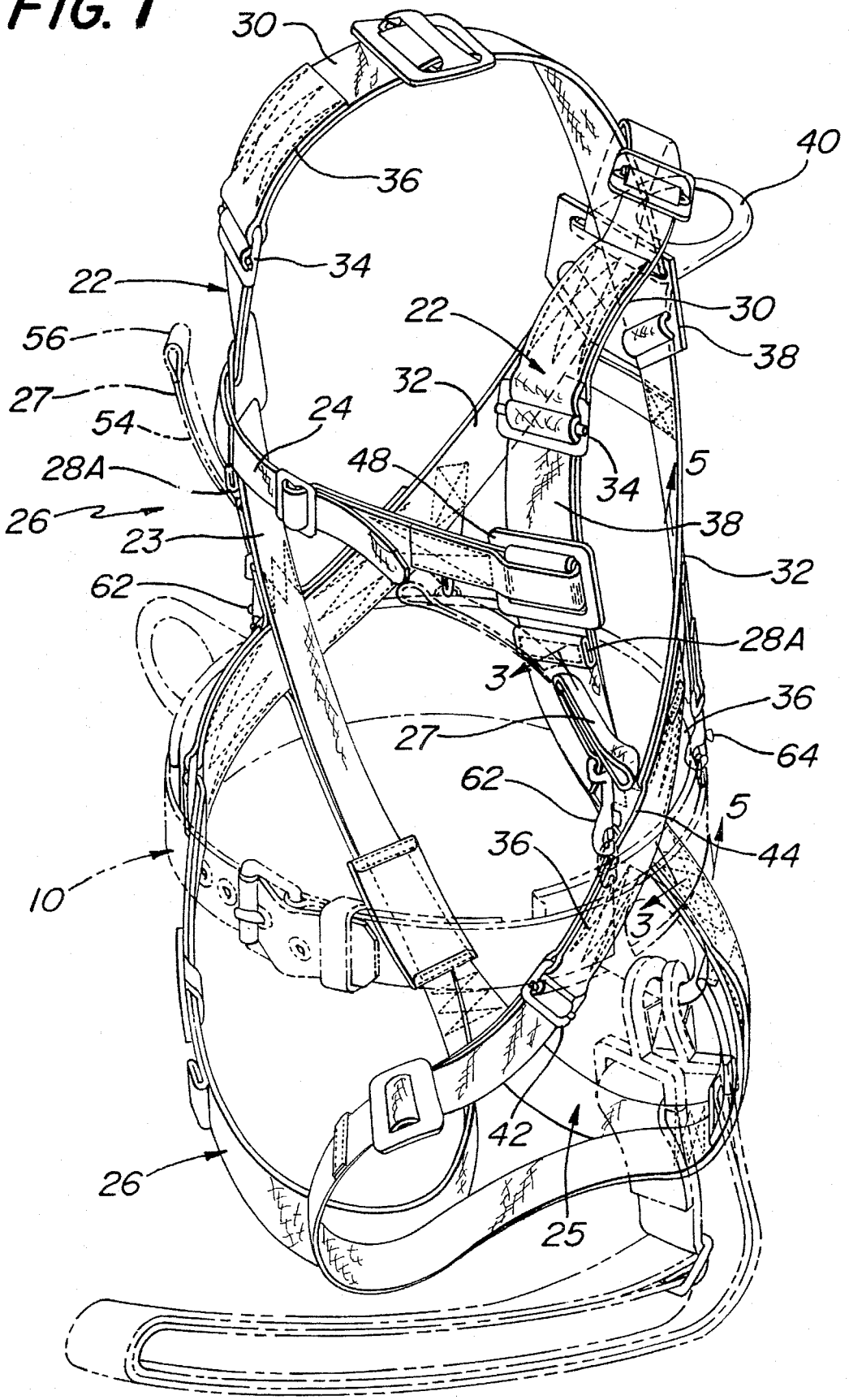
FIG. 1 is an isometric view of a harness constructed in accordance with this invention shown supporting a conventional tool or lineman's belt (the tool belt or lineman's belt being shown by phantom lines)

Referring now to various figures of the drawing where like reference numerals refer to like parts there is shown at 20 in FIG. 1, a harness constructed in accordance with this invention. The harness 20 is arranged to be worn by the person to support/suspend him or her at an elevated position so that he/she can perform some activity thereat, substantially unencumbered or unhindered by the harness, or to connect to it any lowering device or to a tie off device for fall prevention purposes. The harness includes means for adjustable suspending a conventional tool belt or lineman's belt 10 therefrom to enable the worker wearing the harness and tool belt to work comfortably.

The harness of this invention is similar in many respects to the harnesses disclosed in my earlier Pat. No. 5,329,884, whose disclosure is incorporated by reference herein. Thus, the common details of the construction of the harness 20 will not be reiterated herein. Rather the harness will be described generally hereinafter.

Figure 2:
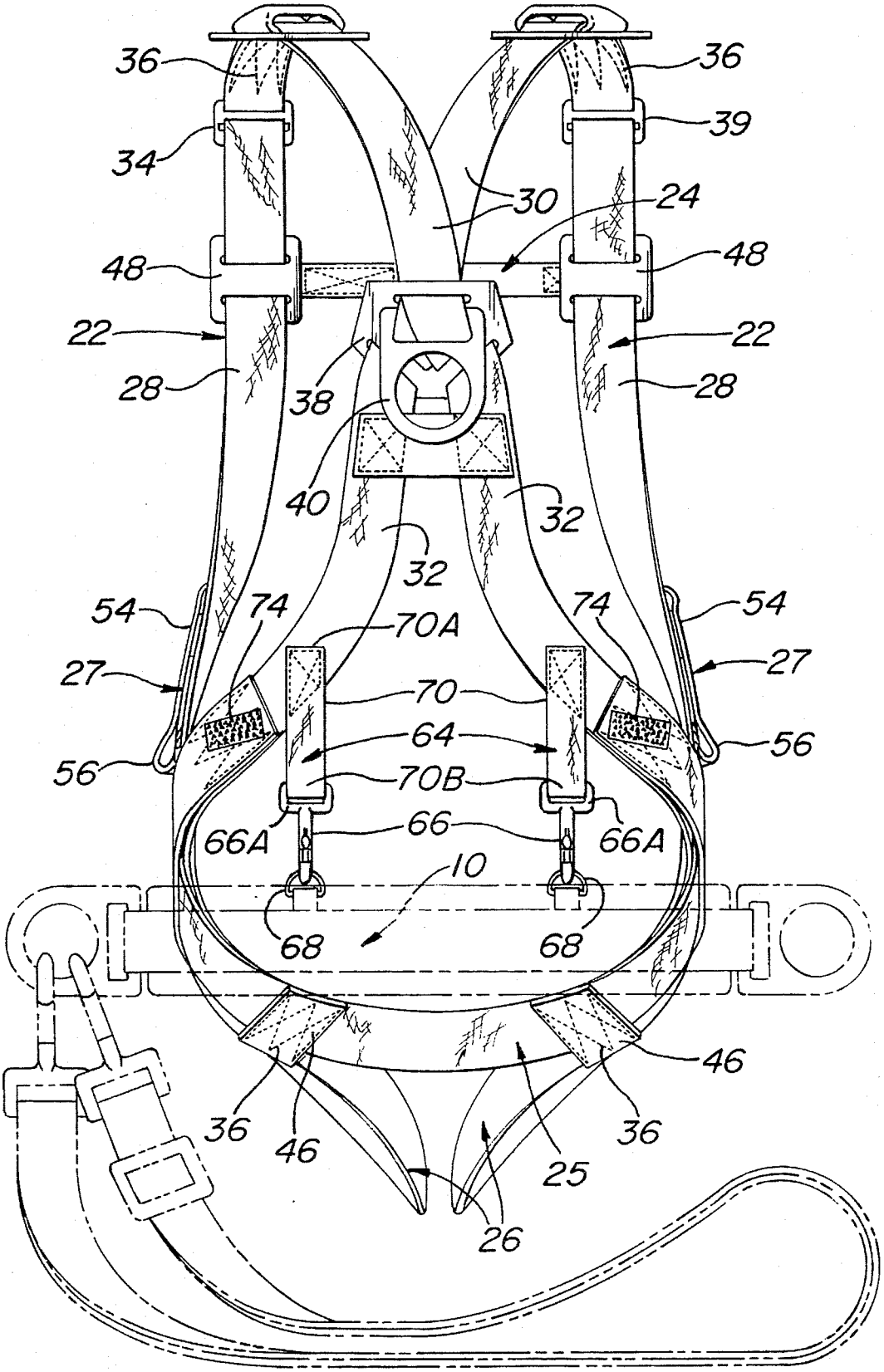
FIG. 2 is a rear elevational view of the harness shown in FIG. 1, with the conventional tool belt suspended therefrom and shown by phantom lines.

As can be seen in FIGS. 1 and 2 the harness 20 of this invention basically comprises a plurality of flexible straps, formed of a high-strength woven plastic or other type material, such as nylon or polyester, which are fixedly secured together, such as by stitching, to form a configuration into which the upper torso and legs of a person (not shown) are held. In particular, the harness includes a pair of upper torso straps 22, a cross-chest strap 24, a seat strap 25, a pair of leg straps 26, and a pair of rappelling straps. Each of the upper torso straps 22 include three portions, namely, a chest side-strap portion 28, a shoulder strap portion 30 and a back strap portion 32. Each chest side-strap portion 28 comprises a vertically extending section arranged to extend vertically adjacent a respect side of the wearer's chest when the harness is worn. The upper end 28A of each chest side-strap portion 28 terminates in a free end which is folded over itself and extended through a releasably securable portion of a conventional buckle 34. The buckle 34 is fixedly secured to an associated shoulder strap portion 30. In particular, the front end of the shoulder strap portion 30 is extended through the buckle 34 and folded over itself and sewn together by plural stitches 36 to secure the buckle in place.

Each shoulder strap portion 30 extends through a cross-buckle 38, formed of any suitable material and located on the back of the harness, so that the shoulder strap portion merges into an associated back strap 32. A conventional D-ring 40 is mounted on the cross-plate 38. The lower end of each of the back straps extends around to the front of the harness and is folded over itself and extended through a conventional buckle 42 to mount the bucket 42 thereon. The folded over portion of the lower end of each back strap is secured in place by lines of stitches 36. A passageway 44 is provided between the overlapping portions of the back strap front between the lines of stitches 36 to enable the lower portion of the chest side-strap portion 28 to extend therethrough. The lower end of each of the chest-side strap portions merges into an associated leg strap 26. The free end of each leg strap extends through the buckle 46, completing a leg loop to accommodate the leg of the wearer. The seat strap 25 is connected between the leg straps 26 and is secured thereto via patches 46 secured by plural lines of stitches 36 (see FIG. 2). The cross-chest strap 24 is connected between the chest side-strap portions 28 by means of a pair of slides 48 mounted thereon.

Each of the rappelling straps 27 comprises a strip or web of the same material as that forming the remainder of the harness straps and includes a first end portion 50, an intermediate portion 52, and a free end portion 54. The end portion 50 is secured by lines of stitches 36 onto an associated chest side-strap portion 28 as shown clearly in FIG. 3. So too, the intermediate portion 52 is secured by lines of stitches 36 onto an associated chest side-strap portion 28. The free end portion 54 of each of the rappelling straps rappelling straps 27 is folded over itself and sewn together to form a loop 56. Each free end portion is arranged to be held in a retracted or stowed position (like shown in FIG. 3) when not in use, but can be readily extended to an extended position (like shown by the phantom lines in FIG. 1) when it is to be used. In order to hold the free end portion of each rappelling strap in the stowed position a pair of cooperating VELCRO strips are fixedly secured, e.g., sewn, onto the outer surface of the extending portion 54 of thereof. In particular, a strip 58 of the VELCRO hook component is sewn onto the intermediate portion 52 of each rappelling strap rappelling strap, and a strip 60 of the VELCRO loop component is sewn onto the free end portion 54. When the free end portion of the rappelling strap is folded over and brought against the intermediate portion thereof the VELCRO strips 58 and 60 releasably engage each other to hold the free end portion 54 in place against the associated chest side-strap portion 28. This ensures that the rappelling straps 27 do not interfere with the wearer's activities or present any tangling hazard. However, when it is desired to connect the harness 20 to a lowering device, rope or other apparatus, the two free end portions 54 of the rappelling straps 27 can be peeled away from the harness so that they extend therefrom so that they can be readily connected to whatever support means are desired, e.g., a lowering or rappelling device via their loops 56.

As should be appreciated by those skilled in the art, with the harness 20 constructed as just described, pulling on the free end portions 28A of the chest side-strap portion 28 as they extend through the buckles 34 effectively shortens the upper torso straps 22 of the harness. Conversely, releasing those free end portion in the buckle allows the lengthening of the upper torso straps 22. This feature enables the harness to be adjusted to accommodate the size of the wearer. In addition, and quite significantly from the standpoint of this invention, the adjustment of the length of the upper torso straps will also effect the raising or lowering of the tool belt 10 when it is suspended from the harness 20, as will be described later.

Figure 3:
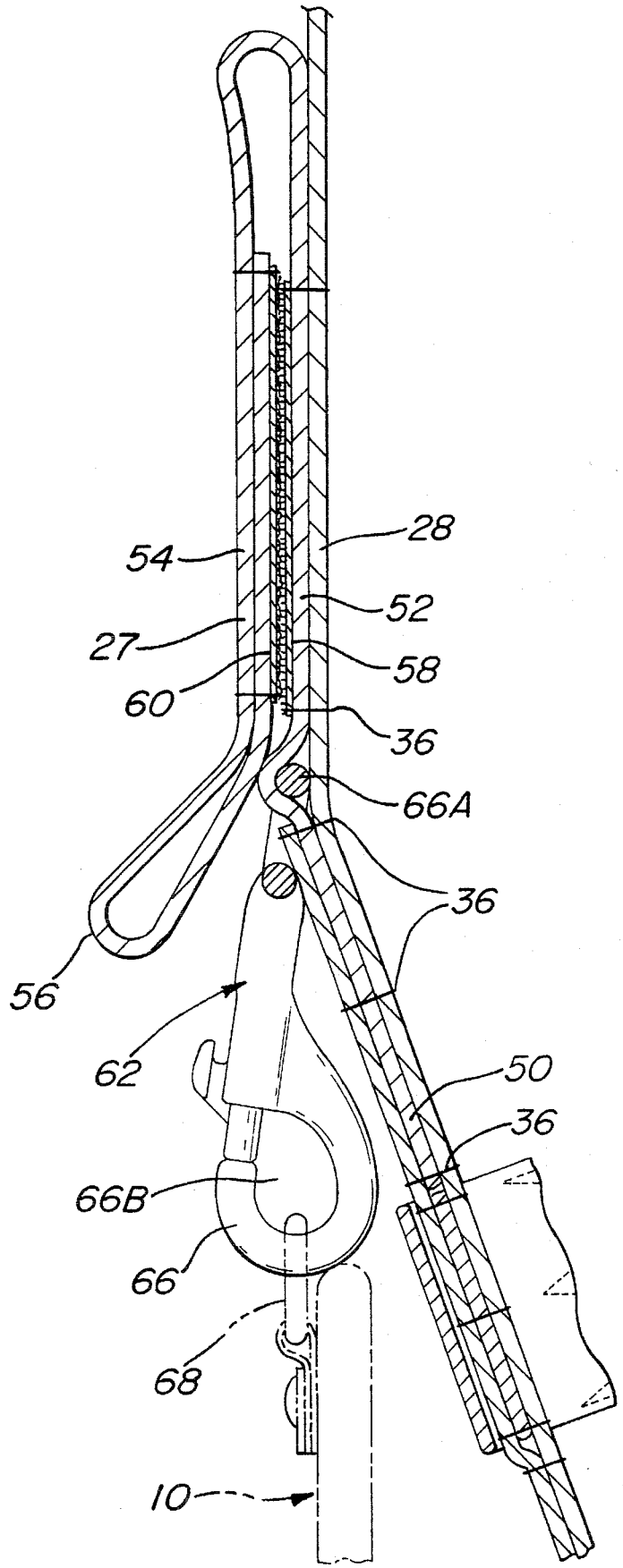
FIG. 3 is an enlarged sectional view taken along line 3—3 of FIG. 1 and showing one of the means mounted on the back of the harness for suspending the rear of the tool belt therefrom, with that means being shown in its stowed position.
Figure 4:
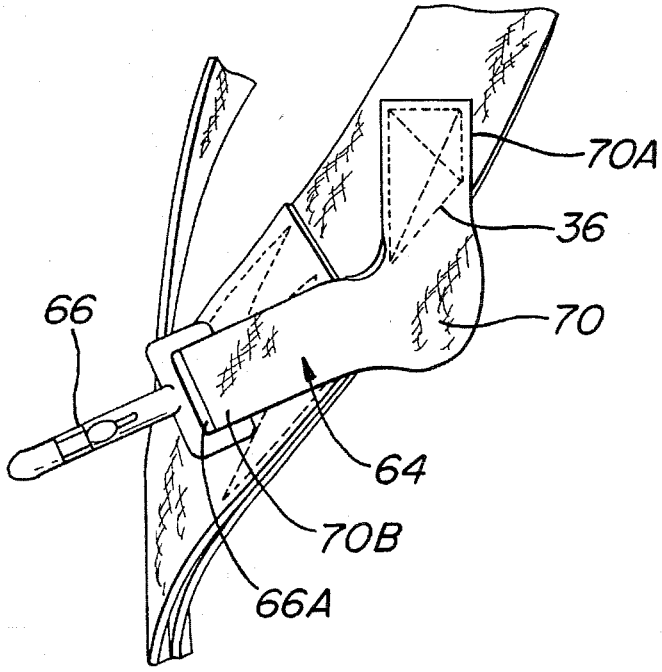
FIG. 4 is an enlarged sectional view of a portion of the front of the harness showing one of the means mounted thereon for suspending the front of the tool belt therefrom.
Figure 5:
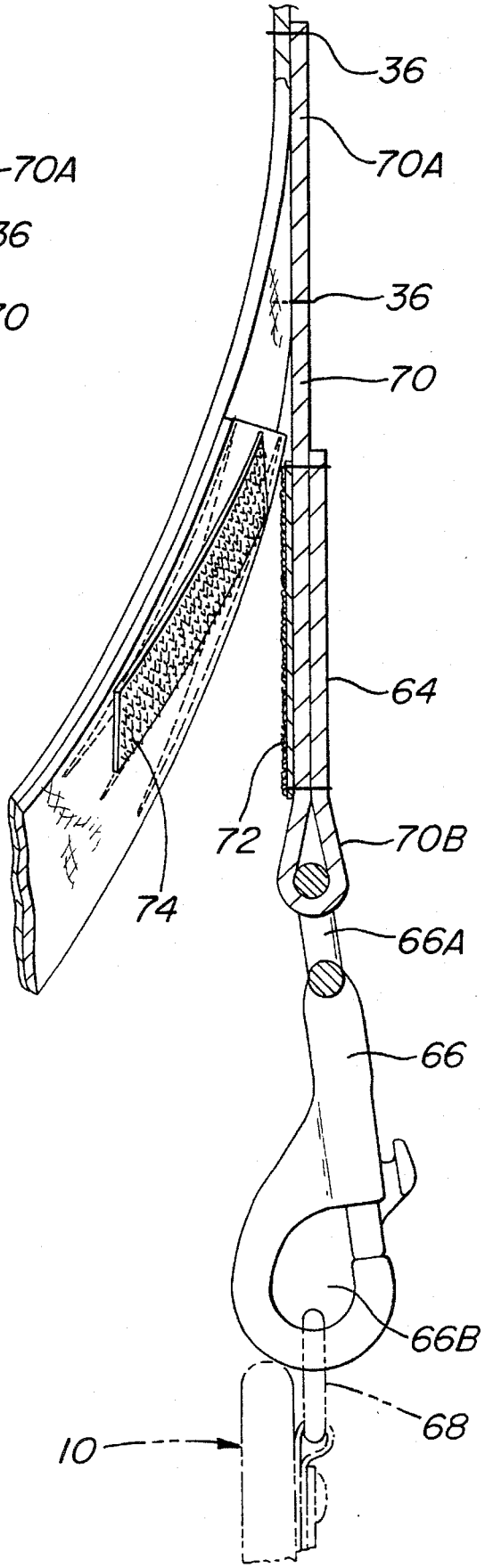
FIG. 5 is an enlarged sectional view taken along line 5—5 of FIG. 1 and showing the means of FIG. 3 for suspending the rear of the tool belt therefrom when such means is in its extended or operative position.

Attention is now directed to FIGS. 3–5 wherein the details of the means for supporting the tool belt are best shown. Those means comprise two pair of suspender members, with one pair of the suspender members being mounted on the front of the harness for supporting the front of the tool belt 10 therefrom, and with the other pair of the suspender members being mounted on the rear or back of the harness for supporting the rear of the tool belt therefrom. The front pair of suspenders is made up of two identical suspenders 62, while the rear pair of suspenders is made up of two identical suspenders 64. The suspenders 62 and 64 are similar in construction except that the suspenders 64 are arranged to be held in a retracted or stowed position until ready for use and then can be extended to an operative position. All of the suspenders include identical connectors 66 for releasable securement to respective portions, e.g., pivot rings 68 (shown in phantom in FIGS. 3 and 5) of the tool belt 10 to support the tool belt from the harness 20. The connectors 66 can be of any suitable construction. In the preferred embodiment shown herein the connectors comprise conventional "bullet catch hooks."

As can be seen in FIGS. 1 and 3 each of the suspenders 62 basically comprises a bullet catch hook 66 having a mounting hole 66A at one end and an openable mouth 66B at the other end. Each of the two hooks 68 forming the front suspenders 62 is mounted on the associated chest-side strap portion of the upper torso strap by extending the intermediate portion 52 of the rappelling strap 27 through the mounting hole 66A, thereby pivotally mounting the hook 66 from the associated chest side-strap portion 28 of the upper torso strap 22 so that the hook hangs down whereupon its openable mouth 66B is directed downward. The openable mouth 68 is thus oriented for receipt of a respective ring 68 of the tool belt therein to suspend that portion of the tool belt therefrom.

Each of the two hooks 68 forming the rear suspenders 64 is mounted on an extendable/stowable strap 70 secured to an associated back strap portion 32 of the upper torso strap 22 as shown clearly in FIG. 2. The strap 70 is formed of the same material as that of the rappelling straps 27 and includes an upper end 70A and a lower, free end 70B. The upper end 70A of each of the straps is secured, e.g., sewn by lines of stitches 36, to an associated back strap portion 32. The lower or free end portion 70B of each strap is extended through the mounting hole 66A of an associated hook 66 and is folded back over itself and sewn together by lines of stitches 36 to thereby pivotally mount the hook 66 therefrom.

Each of the straps 70 is arranged to be held in a retracted or stowed position (like shown in FIG. 4) when not in use, but can be readily extended to an extended position (like shown in FIG. 5) when it is to be used. In order to hold the free end portion of each strap 70 in the stowed position a strip 72 of the loop element of a VELCRO fastener is fixedly secured, e.g., sewn by the lines of stitches 36 onto the inner surface of the strap 70 adjacent the hook 66. A strip 72 of the VELCRO hook component is sewn onto the associated portion of the back strap portion 32 below the point at which the upper end of the strap 70 is secured. Accordingly, when it is not desired to use the suspenders 64 the lower end of their straps 70 are moved so that the VELCRO strips 72 and 74 releasably engage each other, thereby holding the strap 70 and their associated hooks 66 in the retracted position shown in FIG. 4. This action prevents the rear suspenders 64 from interfering with the activities of the user or present any tangling hazard. However, when it is desired to suspend the tool belt 10 from the harness 20 the two free end portions of the straps 70 can be peeled away from the harness so that they extend downward therefrom, whereupon the hooks 66 can receive the rings 68 of the tool belt in their mouths 66B.

As should be appreciated from the foregoing, with the tool belt being suspended from the harness 20 by the two front suspenders 62 and the two rears suspenders, the wearer can raised the height of the tool belt to a comfortable position on his/her body, e.g., to the waist, by merely pulling on the free ends of the strap portions 28A of the upper torso straps 22. This action has the effect of shortening the length of the chest-side strap portions 28 and the rear strap portions 32, thereby raising the front and back of the tool belt 10 to the desired position. If the wearer wishes to lower the tool belt to a buttocks-engaging position, e.g., so that the tool belt can be used for positioning purposes, all that is required is to release the buckles 34 so that the upper torso straps can be lengthened, thereby automatically lengthening the chest-side strap portions 28 and the back strap portions 32. Once the positioning use of the tool belt is no longer needed the tool belt can again be raised to a comfortable, higher position, e.g., to the waist for climbing.

It should be pointed out at this juncture that the harnesses shown and described above are merely exemplary of harnesses which may be constructed in accordance with this invention. Thus, harnesses of this invention need not include rappelling straps, extendable or otherwise, or seat straps.

Without further elaboration the foregoing will so fully illustrate my invention that others may, by applying current or future knowledge, adapt the same for use under various conditions of service.

I claim:

1. A harnesses for protecting a worker from a fall off of an elevated structure, said harness being formed of a flexible material to be worn by the worker for supporting a tool belt therefrom, said harness comprising a pair of leg straps, a pair of upper torso straps, and four belt suspenders, each of said leg straps being arranged for extending about a respective leg of the person, each of said upper torso straps including a chest strap portion and a back strap portion, with said chest strap portions extending across respective portions of the chest of the person, and with said back strap portions extending across respective portions of the back of the person, two of said belt suspenders being mounted on respective ones of said back strap portions of said pair of upper torso straps to form a right rear belt suspender and a left rear belt suspender and the other two of said belt suspenders being mounted on respective ones of said chest strap portions of said pair of upper torso straps to form a right front belt suspender and a left front belt suspender, each of said belt suspenders comprising connector means, said connector means being arranged to connect to respective portions of the tool belt to suspend the tool belt from said harness, one of said upper torso straps being adjustable in length to enable the portions of the tool belt suspended by the one front belt suspender and the one rear belt suspender mounted on said one of said upper torso straps to be raised or lowered together by the adjustment of the length of said one of said upper torso straps, the other of said upper torso straps being adjustable in length to enable the portions of the tool belt suspended by the other front belt suspender and the other rear belt suspender mounted on said other of said upper torso straps to be raised or lowered together by the adjustment of the length of said other upper torso strap.

2. The harness of claim 1 wherein each of said rear belt suspenders is in the form of a belt suspension strap, each strap having a free end at which said connector means is mounted.

3. The harness of claim 2 wherein each of said belt suspension straps is arranged to be releasably stored in a stowed position against said torso belt portion on which it is mounted when not in use for suspending the tool belt therefrom, and to be extended to a suspension position wherein said free end is located spaced from said torso belt portion when the tool belt is suspended therefrom.

4. The harness of claim 3 wherein each of said belt suspension straps include hook and loop releasably securable fastening means to releasably hold said suspension straps in said stowed position.

5. The harness of claim 1 wherein said connector means comprise plural clasps.

6. The harness of claim 2 wherein said connector means comprises a first pair of clasps, with said clasps of said first pair of clasps being mounted on respective ones of said belt suspension straps of said rear belt suspenders.

7. The harness of claim 6 wherein said connector means additionally comprise a second pair of clasps, with respective ones of said second pair of clasps forming respective portions of said front belt suspenders.

* * * * *